US005829707A

United States Patent [19]

Lamothe

[11] Patent Number: 5,829,707

[45] Date of Patent: Nov. 3, 1998

[54] DOUBLE-SIDED WEB PRINTING SYSTEM

[75] Inventor: Richard P. Lamothe, Burlington, Conn.

[73] Assignee: Energy Saving Products and Sales Corporation, Burlington, Conn.

[21] Appl. No.: 853,614

[22] Filed: May 9, 1997

[51] Int. Cl.[6] ..... B65H 18/08; B65H 23/00; B65H 16/10

[52] U.S. Cl. ..... 242/538.2; 242/548; 242/615.21; 242/535.2; 242/564.3; 242/566; 399/384

[58] Field of Search ..... 242/538.2, 538.3, 242/548, 615.21, 535.2, 543, 564.3, 566; 399/384; 101/220, 225

[56] References Cited

U.S. PATENT DOCUMENTS

| | | | |
|---|---|---|---|
| 3,206,089 | 9/1965 | Huck | 242/615.21 X |
| 3,906,855 | 9/1975 | Laursen | 242/615.21 X |
| 5,108,022 | 4/1992 | Birkmair et al. | 242/615.21 X |

*Primary Examiner*—John Q. Nguyen

*Attorney, Agent, or Firm*—McCormick, Paulding & Huber

[57] ABSTRACT

Laser printers are provided parallel one another so that their respective control panels face one another to define a single work station. Paper web travels from an unwind machine through the first laser printer, and instead of being provided directly to a rewind roll or the like, the paper web is adapted to move around turning bars associated with the output end of the laser printer and the input end of a second laser printer. The turning bars are oriented parallel to one another and a reversing roller results in travel of the paper web, in an upside down fashion, to a second laser printer so that it can be printed on one side in the first laser printer and on the opposite side in the second laser printer. The laser printers are also capable of printing on two individual paper webs with individual unwind and rewind machines associated with the opposite ends of the two laser printers thereby providing for conventional operation of the laser printers in an alternative mode of operation. Even so, the advantage of providing a single work station between the laser printers still exists. The laser printers are electrically interfaced with one another so that printing on the opposite sides of the web can be coordinated.

4 Claims, 1 Drawing Sheet

DOUBLE-SIDED WEB PRINTING SYSTEM

CROSS-REFERENCE TO RELATED APPLICATIONS

This application is related to U.S. Pat. No. 5,505,401 and several related applications which are continuations thereof, namely Ser. No. 488,508 U.S. Pat. No. 5,617,1346 filed Dec. 7, 1995 and Ser. No. 679,992 filed Jul. 15, 1996, abandoned.

The above-identified patent and applications are incorporated herein by reference. All of these applications, including the current application, relate to high speed laser printers of the type adapted for use with an unwind machine at the input end of the laser printer, and a rewind machine provided at the output end of the laser printer.

Application Ser. No. 679,992 is entitled SIDE-BY-SIDE ROLL UNWIND AND REWIND, and relates to providing an unwind machine along-side the rewind machine, and providing a frame that includes a driven torque roller forming a tension free loop for the web material at the downstream end of the printer. In that application, the unwind machine includes canted mutually related angled rollers for reorienting the web in order to feed the printed web through successive 90° turns so that it can be aligned with and accommodated by the rewind machine in its position along-side of the unwind machine. As a result of this arrangement, better access is provided to both the unwind and the rewind machines because both are located side-by-side at the same end of the laser printer and space is saved in the print shop with a setup as described therein.

BACKGROUND OF THE INVENTION

The present invention relates to providing two laser printers in an arrangement which provides for printing on both sides of the paper web as it is fed from the unwind machine successively through the laser printers and thence onto an unwind machine.

Thus, the general purpose and object of the present invention is to provide for printing on both sides of the paper web fed from an unwind machine through one laser printer and thence, through a second laser printer which is provided in a convenient arrangement with respect to the first laser printer, and from which the paper web can be withdrawn for storage on a roll in a rewind machine.

SUMMARY OF THE INVENTION

In accordance with the present invention, a system is provided for feeding paper web material through two laser printers which have control panels for controlling their respective operation, said system comprises an unwind machine for feeding the paper web in a first direction into the input end of one of the two laser printers where the web is printed on one side. The laser printer includes conventional means for pulling the paper web as required in said first direction at an intermittent or variable speed. Paper web handling means is provided at the output end of the one laser printer, and includes torque means for providing a tension free loop in the web at the output end of the one laser printer. Also included are guide bar means for turning the paper web through 90° and changing the direction of web movement into a second direction perpendicular to said first direction. Second guide bar means is provided for turning the paper web through an additional 90° and changing its direction of movement to a third direction which is perpendicular to the second direction and parallel to, but opposite the first direction. This third direction of web movement is spaced from the first so as to define a work station therebetween, wheels work station affords ready access to the control panels of said two laser printers.

The advantages of the present invention include the following:

First of all, a common work station is provided between two laser printers that are fed the paper web through unique paper web handling means that allow for printing of the web on both sides as the paper web moves in a generally U-shaped path from an unwind machine to a rewind machine. Another feature of the invention is that said unwind and rewind machines are provided at the same side of the laser printers, and are located adjacent to, but spaced from one another by the lateral distance between the two laser printers which also serves to define the work station itself.

Another advantage of the present invention can be attributed to the provision for one laser printer handling the paper web in one direction where the second laser printer handles the same paper web, or another paper web, moving in an opposite direction spaced from the first direction. In the latter case, an additional unwind and rewind machine must be provided on the input and output ends respectively of the second and first laser printers.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawing wherein:

FIG. 1 also shows an alternative set up for handling independently feedable paper webs from not only the first mentioned unwind machine, but also from a second unwind machine associated with the second laser printer. A second rewind machine is provided at the output end of the first laser printer for receiving the paper web printed upon by the first laser printer.

DETAILED DESCRIPTION

Figure 1:
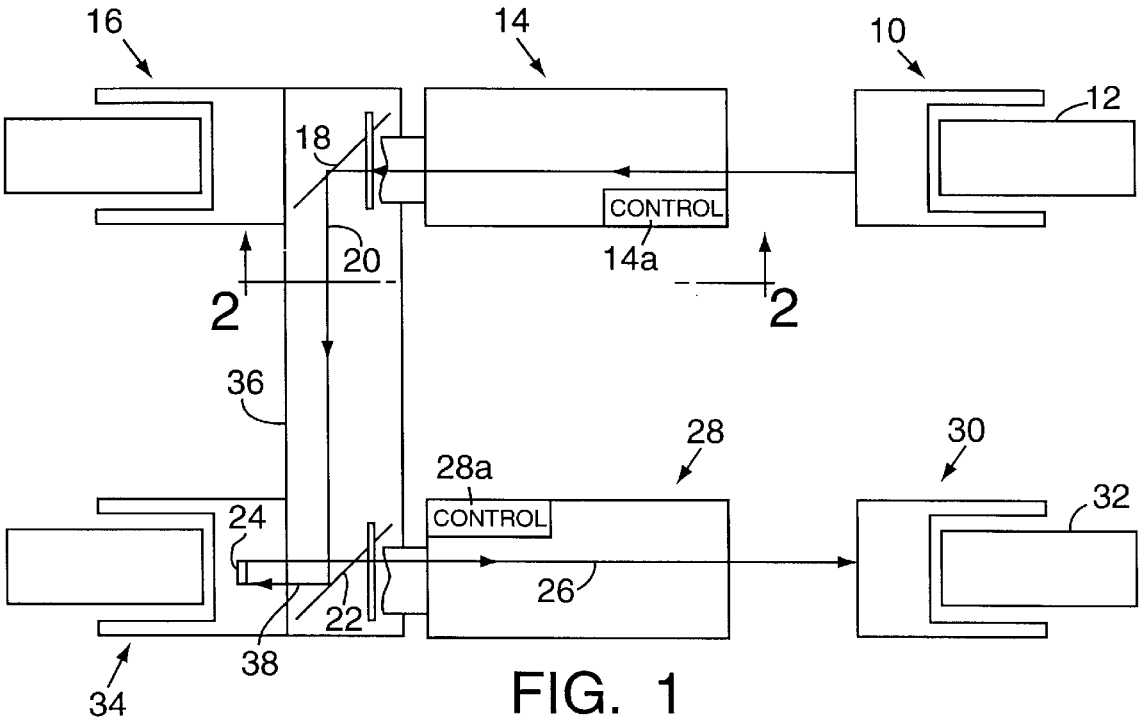
FIG. 1 is a plan view showing, in a schematic fashion, the arrangement of the two laser printers together with the direction of movement of the paper web from a first unwind machine through the first laser printer and thence, laterally to be reoriented for passage through the second laser printer such that the opposite side of the paper web can be printer prior to being rewound on a rewind machine provided alongside the unwind machine.

Turning now to the drawing in greater detail, a first unwind machine is indicated generally at 10, and this unwind machine is essentially equivalent to the unwind machines described in the patent and applications incorporated by reference herein. A paper roll 12 is provided in the unwind machine, and is subjected to web handling rollers which provide a tension free loop between the unwind machine and a first laser printer indicated generally at 14. The laser printer 14 is of conventional construction and preferably of the type described in the above-mentioned patent and applications and includes means for withdrawing paper web from the unwind machine through a tension free loop so as to accommodate changes in the speed of the paper web through the printer, and also to accommodate slight changes in direction of web movement at the laser printer.

In accordance with conventional practice, the paper web would normally pass directly to a rewind machine, such as indicated generally at 16, where the paper web is rewound on a roll for further processing. In accordance with conventional practice, such a paper roll would have to be unwound once again for entry through a second laser printer in the event that the paper web were to be printed on both sides.

Figure 2:
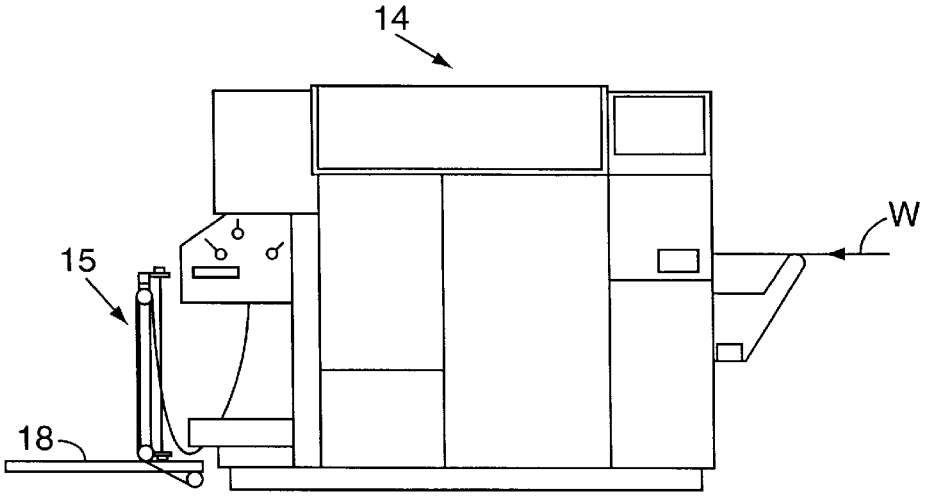
FIG. 2 is an elevational view of the first laser printer showing a tension free loop at the output end thereof, and the means for turning the web for travel toward the viewer.

In accordance with the present invention, the paper web output from the laser printer 14 is instead provided to web guiding means best shown in FIG. 2 in the form of a roll stand 15 capable of creating a tension free web between it and the output end of the laser printer 14, following which the paper web is passed around a turning bar 18 where the web's direction is changed from the first direction, which is generally right to left in FIG. 1, through the laser printer 14 to a direction perpendicular to this first direction as indicated generally by the arrow 20 in FIG. 1.

FIG. 2 illustrates in an elevational view, the path taken by the web into the laser printer 14 and through the tension free loop so as to be redirected toward the floor and around the turning bar 18 where the web will have changed direction 90° to move in a direction perpendicular to the first direction indicated generally by the web W in this view.

A second turning bar 22 is provided along this second path 20 of the web as indicated generally in FIG. 1, as a result of which the web moves in a third direction parallel to the first direction and initially, at least, in the same direction and thence around a reversing roller 24 which results in the web being traveling in a third direction along a path 26 opposite the first direction through a second laser printer 28. The second laser printer 28, like the first laser printer 14, includes internal mechanism for advancing the web in the direction indicated at the input end of the laser printer 28 toward the output end. At the output end of the second laser printer 28, a rewind machine 30 is provided, which rewind machine includes suitable means for withdrawing the web from the variable speed laser printer and providing the resulting paper web on a rewind roll as indicated generally at 32 in FIG. 1

An important feature of the present invention is attributed to the fact that the first and second laser printers 14 and 28 are provided facing one another so that a single laser printer operator at the work station defined between these laser printers has access to the control panels of each, which control panels are indicated generally at 14*a* and 28*a* in FIG. 1.

A further feature of the present invention can be attributed to the fact that the web is turned through a first 90° angle at the output end of the first laser printer and then reversed in direction again at the input end of the second laser printer so that the paper web not only reverses direction to follow the parallel course indicated generally at 26 for it through the second laser printer, but so that the paper web will have been turned over so as to allow printing on the reverse side in the second laser printer 28.

In further accordance with the present invention, an unwind machine 34 can be provided as shown in FIG. 1 so as to allow operation of the second laser printer 28 independently of the first laser printer 14 in situations where each laser printer is set up for printing on only one side of paper webs associated with each independently operated printer. It should be noted that the paper web guiding means associated with the output end of the first laser printer 14 and with the input end of the second laser printer are so provided as to be out of the way of the web paths during this more conventional set up. This feature is suggested in FIG. 2 whereby changeover from the double-sided printing described previously can be accomplished readily to and from the single sided printing of individual paper webs in each of these two side-by-side laser printers.

In conclusion, the advantages to the present invention are many, including the capability of feeding independent paper webs through each of the laser printers as described above without removing or replacing the web guiding means associated with the web turn over feature that allows printing on both sides of a single paper web. This result is due in large part to the fact that the web 20 passes parallel to and adjacent the floor upon which the laser printers are provided through a tunnel 36, which tunnel includes the turning bars 18 and 22. Preferably, these turning bars 18 and 22 are arranged parallel to one another so that the web, as it travels in the direction of the arrow 38, also passes around the reversing roller 24 and returns in the direction of the arrow 26 in a proper orientation that allows printing on its reverse side as compared to the printing accomplished in the first printer 14.

The two printers must be electrically interfaced to provide for effective duplex or double-side printing by separate laser printers. Such a link can be provided electronically, and also can assume that the speeds of the web in both laser printers are closely matched. A switch is preferably provided to disable such electronic linking when the laser printers are to be used in the simplex modes described above.

Variations of the above-described structure will occur to those skilled in the art given the disclosure made herein. For example, the turning bars 18 and 22 might be provided in spaced relationship above the floor as long as they are out of the path traveled by the webs when the webs are printed independently in each of the laser printers 14 and 28. Also, other web guiding means might be provided to achieve the turning of the paper web that allows printing on its reverse side. However, the present invention provides this feature in combination with the concept of defining a single work station between the two laser printers so as to allow a single operator to control both laser printers without leaving his station. This advantage is not shown or suggested in the prior art generally and represents a substantial advantage to the arrangement defined by the appended claims.

I claim:

1. A system for feeding paper web material through two laser printers, each printer having a control panel for operation of that printer, said system comprising:

an unwind machine for feeding the paper web in a first direction into the input end of one of the two laser printers such that the web is printed on one side, the laser printers including conventional means for pulling the paper web at an intermittent speed, to provide outputted paper web at discharge ends thereof, paper web handling means at the output end of the one laser printer, said paper web handling means including means for providing a tension free loop in the web at the output end of the one laser printer, and including guide bar means for turning the paper web through 90° and changing the direction of web movement into a second direction generally perpendicular to said first direction, second guide bar means for turning the paper web through an additional 90° and changing its direction of movement to a third direction which is generally perpendicular to the second direction and generally parallel to the first direction, the second one of the laser printers being positioned along said third direction to receive the web being fed in said third direction, said third direction being opposite the first direction and spaced therefrom so as to define a work station therebetween and between the two laser printers, said work station affording access to the control panels of both said two laser printers.

2. The system according to claim 1 further including a rewinding machine for rewinding the paper web outputted from the second laser printer, said rewinding machine provided alongside said unwind machine and in spaced relation thereto.

3. The system according to claim 2, wherein said paper web handling means comprises first and second paper web handling means so arranged with respect to the first and third directions respectively as to allow two independent paper webs to be passed independently through each of said two laser printers, one of said two web in said first direction from the unwind machine to a second rewind machine located opposite said unwind machine with respect to the first laser printer, and a second web from a second unwind machine provided opposite said rewind machine associated with said second laser printer for providing an independent paper web from said second unwind to said rewind machine.

4. The system according to claim 1, wherein said second guide bar means includes means for changing the direction of movement of said paper web along said second direction so as to first provide a path parallel to and in the same direction as said first direction, and said second guide bar means further including a reversing roller to reverse the direction of travel of said paper web in order to achieve said third direction of movement which is parallel to, but spaced from said first direction of movement of said paper web through said first laser printer.

* * * * *